US009239179B2

(12) United States Patent
Song et al.

(10) Patent No.: US 9,239,179 B2
(45) Date of Patent: Jan. 19, 2016

(54) AIR CONDITIONER

(71) Applicant: LG ELECTRONICS INC., Seoul (KR)

(72) Inventors: Chiwoo Song, Seoul (KR); Yongcheol Sa, Seoul (KR); Hojong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 61 days.

(21) Appl. No.: 13/957,718

(22) Filed: Aug. 2, 2013

(65) Prior Publication Data

US 2014/0033741 A1 Feb. 6, 2014

(30) Foreign Application Priority Data

Aug. 2, 2012 (KR) ..... 10-2012-0084718

(51) Int. Cl.

| | |
|---|---|
| ***F25B 45/00*** | (2006.01) |
| ***F25B 1/00*** | (2006.01) |
| ***F24F 1/26*** | (2011.01) |
| ***F24F 1/32*** | (2011.01) |

(52) U.S. Cl.

CPC . *F25B 45/00* (2013.01); *F24F 1/26* (2013.01); *F24F 1/32* (2013.01); *F25B 1/00* (2013.01)

(58) Field of Classification Search

CPC ..... F25B 45/00; F25B 1/00; F24F 1/26; F24F 1/32

USPC ..... 62/503, 509, 513

See application file for complete search history.

(56) References Cited

U.S. PATENT DOCUMENTS

| | | | | |
|---|---|---|---|---|
| 3,721,104 | A * | 3/1973 | Adler | 62/240 |
| 4,012,921 | A * | 3/1977 | Willitts et al. | 62/151 |
| 4,236,381 | A * | 12/1980 | Imral et al. | 62/324.1 |
| 4,554,795 | A * | 11/1985 | Ibrahim | 62/175 |
| 4,831,835 | A * | 5/1989 | Beehler et al. | 62/196.1 |
| 5,551,249 | A * | 9/1996 | Van Steenburgh, Jr. | 62/196.4 |
| 5,694,783 | A * | 12/1997 | Bartlett | 62/211 |
| 6,041,618 | A * | 3/2000 | Patel et al. | 62/503 |
| 6,192,696 | B1 * | 2/2001 | Shimamoto et al. | 62/209 |

(Continued)

FOREIGN PATENT DOCUMENTS

| | | | |
|---|---|---|---|
| EP | 2434236 | A2 * | 3/2012 |
| JP | 06-288656 | | 10/1994 |
| JP | 2002-295927 | | 10/2002 |

(Continued)

OTHER PUBLICATIONS

Korean Notice of Allowance issued in related Application No. 10-2012-0084718 dated May 28, 2014.

*Primary Examiner* — Mohammad M Ali

(74) *Attorney, Agent, or Firm* — Ked & Associates, LLP

(57) ABSTRACT

An air conditioner is provided. The air conditioner may include a compressor, a condenser, an evaporator, a receiver storing a portion of a refrigerant passing through the condenser, an accumulator receiving refrigerant stored in the receiver and refrigerant passing through the evaporator to separate gas refrigerant from refrigerant introduced therein and supply the gas refrigerant to the compressor, and a bypass line supplying refrigerant from the receiver to the accumulator. The receiver and the accumulator may be integrally formed or provided as separate parts coupled each other. An outlet end of the bypass line may be connected to an upper portion of the accumulator. Such an arrangement may prevent refrigerant from flowing backward from the accumulator into the receiver.

17 Claims, 6 Drawing Sheets

(56) References Cited

U.S. PATENT DOCUMENTS

| | | | | |
|---|---|---|---|---|
| 2005/0044864 | A1* | 3/2005 | Manole et al. | 62/149 |
| 2009/0114309 | A1* | 5/2009 | Sakai et al. | 141/1 |

FOREIGN PATENT DOCUMENTS

| | | |
|---|---|---|
| JP | 2011-247476 | 12/2011 |
| KR | 10-2013-0028474 | 3/2013 |

* cited by examiner

AIR CONDITIONER

CROSS-REFERENCE TO RELATED APPLICATION(S)

This application claims priority under 35 U.S.C. §119 to Korean Application No. 10-2012-0084718 filed on Aug. 2, 2012, whose entire disclosure is hereby incorporated by reference.

BACKGROUND

1. Field

This relates to an air conditioner.

2. Background

Multi-type air conditioners may include a plurality of indoor units connected to one outdoor unit, with a plurality of tubes connected to the outdoor unit to respectively supply refrigerant to each of the plurality of indoor units, thereby conditioning indoor air through each of the indoor units. Such multi-type air conditioners may have relatively inexpensive initial investment costs, and may require a relatively small indoor area to accommodate the indoor units.

DETAILED DESCRIPTION

In the following detailed description, reference is made to the accompanying drawings that form a part hereof, and in which is shown by way of illustration various exemplary embodiments. These embodiments are described in sufficient detail to enable those skilled in the art, and it is understood that other embodiments may be utilized and that logical structural, mechanical, electrical, and chemical changes may be made without departing from the spirit or scope as broadly described herein. To avoid detail not necessary to enable those skilled in the art, the description may omit certain information known to those skilled in the art. The following detailed description is, therefore, not to be taken in a limiting sense.

Figure 1:
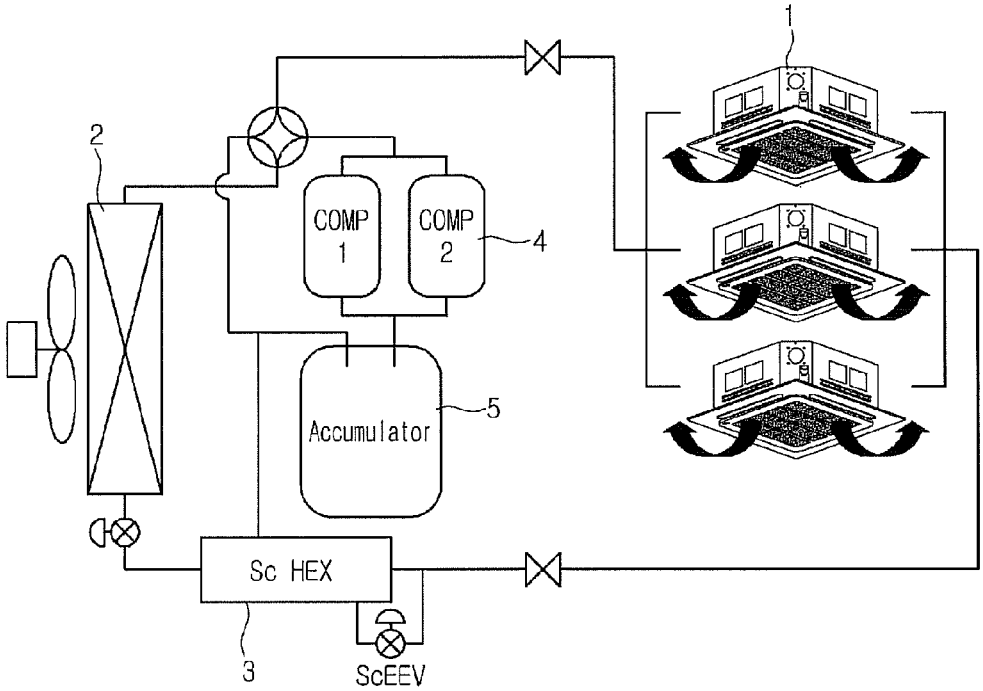
FIG. 1 is a schematic view of an exemplary multi-type air conditioner.

Referring to FIG. 1, an exemplary multi-type air conditioner 10 may include a plurality of indoor units 1, an outdoor heat exchanger 2, an overcooling heat exchanger 3, a compressor 4, and an accumulator 5. In a cooling mode, refrigerant discharged from the compressor 4 may pass through a 4-way valve in a high-temperature high-pressure gas state and then be condensed in an outdoor heat exchanger (a condenser) 2. The condensed refrigerant may then flow into the outdoor heat exchanger 2 in a high-temperature high-pressure liquid state.

Thereafter, the refrigerant decreases in temperature while passing through the overcooling heat exchanger 3 and then is introduced into each of the indoor units 1. The refrigerant may then change in phase into a low-temperature low-pressure two-phase refrigerant while passing through an electric expansion valve (EEV) of each of the indoor units 1. The refrigerant may heated through heat-exchange with indoor air while passing through the indoor units (evaporator) 1, and be introduced into the outdoor heat exchanger 2. The refrigerant may then be introduced into the compressor 4 via the 4-way valve and the accumulator 5. In the heating mode, each of the indoor units 1 may serve as a condenser, and the outdoor heat exchanger 2 may serve as an evaporator. Thus, in the heating mode, refrigerant may flow in a direction opposite to that in the cooling mode.

However, in the multi-type air conditioner 10 shown in FIG. 1, when the air conditioner 10 operates under a partial cooling load, one or more of the connected indoor units 1 may be stopped. Thus, refrigerant in a low-pressure gas state may remain in the one or more non-operational indoor units 1. As a result, the refrigerant within the non-operating indoor unit(s) 1 may flow into the outdoor heat exchanger 2. Thus, since an available amount of refrigerant within a particular system is altered, it may be difficult to maintain optimal refrigerant distribution, thereby deteriorating operation efficiency. Also, during the heating operation, since functional roles of the condenser and the evaporator are changed, an indoor/outdoor heat exchange volume ratio may vary according to the number of connected indoor units 1.

Figure 2:
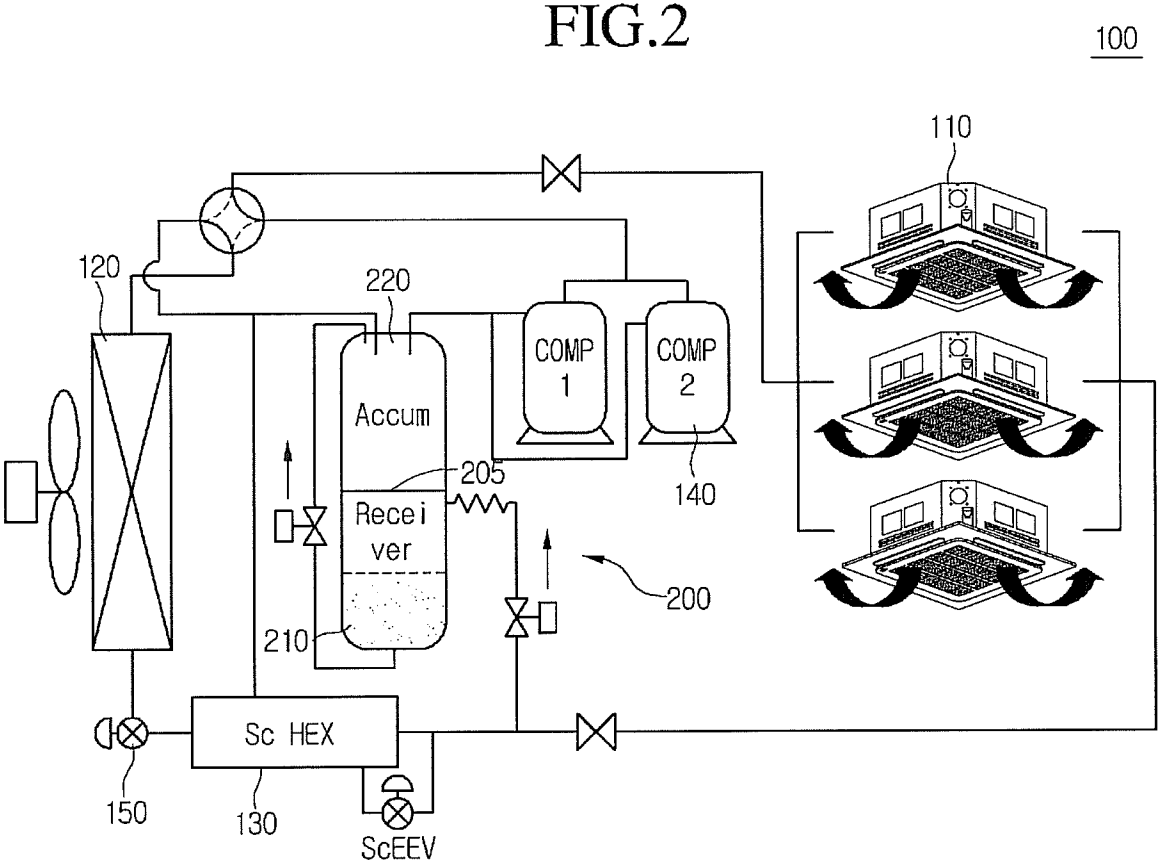
FIG. 2 is a schematic view of an air conditioner according to an embodiment as broadly described herein.

Referring to FIG. 2, an air conditioner 100 as embodied and broadly described herein may include one or more indoor units 110, an outdoor heat exchanger 120, an auxiliary heat exchanger 130, a compressor 140, an expansion device 150, and a refrigerant storage device 200.

The indoor unit 110 may serve as an evaporator evaporating a refrigerant having a low-temperature low-pressure liquid state to change to a gas state when a cooling operation is performed. On the other hand, when a heating operation is performed, the indoor unit 110 may serve as a condenser condensing a refrigerant having a high-temperature high-pressure gas state to change to a room-temperature high-pressure liquid state. A plurality of indoor units 110 may correspond to one outdoor heat exchanger 120, and embodiments are not limited to a particular shape and/or type of indoor units.

The outdoor heat exchanger 120 may serve as a condenser condensing a refrigerant having a high-temperature high-pressure gas state into a room-temperature high-pressure liquid state when the cooling operation is performed. On the other hand, when the heating operation is performed, the outdoor heat exchanger 120 may serve as an evaporator evaporating a refrigerant having a low-temperature low-pressure liquid state into a gas state. Since the indoor unit 110 operates reversely according to circulation of the refrigerant, a user may perform a desired air conditioning function.

The auxiliary heat exchanger 130 overcools the refrigerant to supply the refrigerant into the evaporator. The auxiliary heat exchanger 130 may overcool, or sub-cool, a liquid refrigerant to improve refrigeration performance.

The compressor 140 may compress a low-temperature low-pressure gas refrigerant at a high-temperature and high-pressure to supply the compressed refrigerant to the condenser. The compressor 140 may be provided in plurality. An inverter compressor in which an operation frequency is convertible and/or a constant speed compressor using a regular operation frequency may be used as the compressor 140.

The expansion device 150 may expand a room-temperature high-pressure liquid refrigerant passing through the condenser into a low-temperature low-pressure liquid refrigerant to be provided to the evaporator. An electric expansion valve (EEV) may be used as the expansion device 150. The expansion device 150 together with the outdoor heat exchanger 120 may be included in the outdoor unit.

The refrigerant storage device 200 may include a receiver 210 and an accumulator 220. The receiver 210 may provide a space in which a refrigerant flowing in a circulation tube is selectively introduced and stored. The receiver 210 may also adjust an amount of refrigerant circulating into the air conditioner 100. The accumulator 220 may receive refrigerant from the evaporator or the receiver 210 to separate the refrigerant into gas and liquid states, thereby supplying only the gas refrigerant to the compressor 140.

The receiver 210 and the accumulator 220 may be integrated with each other. That is, a space for the gas/liquid separation and space for performing a receiver function within a single housing may be partitioned by a partition wall 205. The partition wall 205 may vertically or horizontally partition the two spaces.

According to the current embodiment, since the receiver 210 and the accumulator 220 may be integrated with each other, a length of a bypass line 240 connecting the receiver 210 to the accumulator 220 may be minimized. The integrated structure of the receiver 210 and the accumulator 220 will be described with reference to the accompanying drawings.

In alternative embodiments, the receiver 210 and the accumulator 220 may be separately manufactured, and then, coupled to each other by welding, a coupling member or other attachment mechanism as appropriate. The receiver 210 and the accumulator 220 may contact each other, or alternatively, the receiver 210 and the accumulator 220 may be fixed at positions spaced apart from each other.

Figure 3:
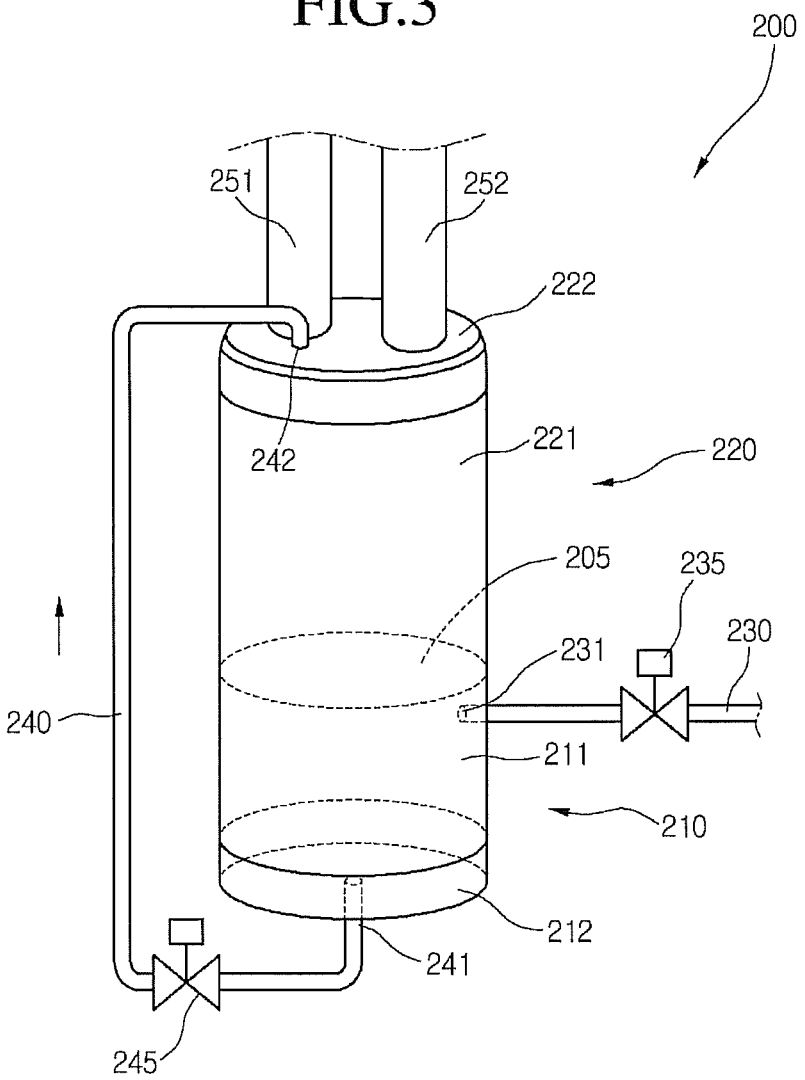
FIG. 3 is a perspective view of a refrigerant storage device of an air conditioner, according to an embodiment as broadly described herein.
Figure 4:
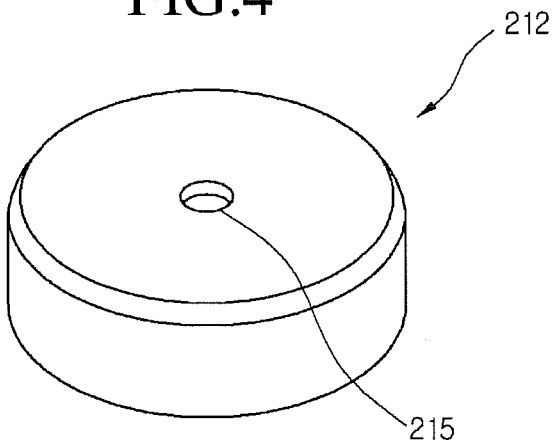
FIG. 4 is a perspective view of a receiver cover of an air conditioner, according to an embodiment as broadly described herein.
Figure 5:
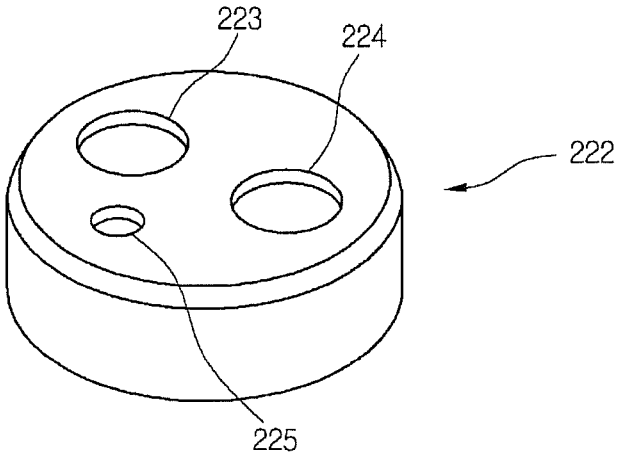
FIG. 5 is a perspective view of an accumulator cover of an air conditioner, according to an embodiment as broadly described herein.

FIG. 3 is a perspective view of a refrigerant storage device according to an embodiment, FIG. 4 is a perspective view of a receiver cover according to an embodiment, and FIG. 5 is a perspective view of an accumulator cover according to an embodiment.

Referring to FIG. 3, the refrigerant storage device 200 may include the receiver 210 and accumulator 220. The refrigerant storage device 200 may have a cylindrical shape. The inside of the cylindrical shape may be bisected by the partition wall 205. The partition wall 205 may bisect the cylindrical shape in a vertical or horizontal direction. FIG. 3 illustrates a structure in which the partition wall 205 is horizontally disposed. The receiver 210 may be disposed below the partition wall 205, and the accumulator 220 may be disposed above the partition wall 205. Also, the receiver 210 and the accumulator 220 may be connected to a plurality of tubes 230, 240, 251 and 252.

The receiver 210 may include a receiver body 211 defining an outer appearance of the receiver 210 and a receiver cover 212 covering a portion of the receiver body 211. In the case where the receiver 210 is disposed below the partition wall 205, the receiver cover 212 may be disposed on a lower end of the receiver body 211. Referring to FIG. 4, a first hole 215 to be connected to the bypass line 240 may be defined in the receiver cover 212.

The accumulator 220 may include an accumulator body 221 defining an outer appearance of the accumulator 220 and an accumulator cover 222 covering a portion of the accumulator body 221. In the case where the accumulator 220 is disposed above the partition wall 205, the accumulator cover 222 may be disposed on an upper end of the accumulator body 221. Referring to FIG. 5, a second hole 223 to be connected to an accumulator inflow tube 251, a third hole 224 to be connected to an accumulator discharge tube 252, and a fourth hole 225 to be connected to the bypass line 240 may be defined in the accumulator cover 222. In this case, since all holes to be formed in the accumulator 220 are defined in the accumulator cover 222, manufacturing costs and process time may be reduced.

The receiver suction tube 230 may be branched from a tube connecting a condenser and an evaporator and then be connected to the receiver 210. Here, an outlet end 231 of the receiver suction tube 230 may be connected to an upper portion of the receiver body 211.

The bypass line 240 may allow the receiver 210 to communicate with the accumulator 220. In detail, an inlet end 241 of the bypass line 240 may be connected to the receiver 210, and an outlet end 242 may be connected to the accumulator 220. Here, the inlet end 241 of the bypass line 240 may be connected to a lower portion of the receiver 210, and the outlet end 242 of the bypass line 240 may be connected to an upper portion of the accumulator 220. For example, the inlet end 241 of the bypass line 240 may be connected to the first hole 215 defined in the receiver cover 212, and the outlet end 242 of the bypass line 240 may be connected to the fourth hole 225 defined in the accumulator cover 222.

In the current embodiment, the receiver cover 212 and the receiver body 211 may be separately manufactured and then be coupled to each other or integrally manufactured. In the case in which the receiver body 211 and the receiver cover 212 are integrally manufactured, the inlet end 241 of the bypass line 240 may be connected to a bottom surface of the receiver body 211.

Also, in the current embodiment, the accumulator body 221 and the accumulator cover 222 may be separately manufactured and then be coupled to each other or integrally manufactured. In the case in which the accumulator body 221 and the accumulator cover 222 are integrally manufactured, the outlet end 242 of the bypass line 240 may be connected to a top surface of the accumulator body 221.

In detail, the bypass line 240 may extend downward from the inlet end 241 in parallel to a length direction of the receiver body 211. The bypass line 240 may be bent, for example, perpendicularly to extend in direction perpendicular to a length direction of the receiver body 211, and then perpendicularly bent again to extend back up toward the accumulator body 221 in a direction parallel to the length direction of the receiver body 211, and then bent perpendicularly toward the accumulator body 221 at a height greater than that of the accumulator body 221. Then, the bypass line 240 may be perpendicularly bent downward and connected to the accumulator cover 222. For example, the bypass line 240 may be bent in a "⊏" shape to allow the receiver 210 to communicate with the accumulator 220.

A first valve 235 adjusting an amount of refrigerant flowing into the receiver suction tube 230 may be disposed in the receiver suction tube 230. A second valve 245 adjusting an amount of refrigerant flowing into the bypass line 240 may be disposed in the bypass line 240.

A normal open valve or normal close valve may be used as the first and second valves 235 and 245, where the normal open valve may be maintained in an open state when power is not applied, and the normal close valve may be maintained in a closed state when power is not applied. To easily perform vacuum formation and refrigerant filling, at least one valve may use the normal open valve.

The accumulator inflow tube 251 may transfer a refrigerant in which a liquid and gas supplied from an evaporator are mixed into the accumulator 220. The accumulator discharge tube 252 may supply a gas refrigerant into a compressor. The accumulator inflow tube 251 and the accumulator discharge tube 252 may be connected to the second hole 223 and the third hole 224 of the accumulator cover 222, respectively.

According to the current embodiment, the outlet end 242 of the bypass line 240 may be connected to an upper portion of the accumulator 220 to prevent the liquid refrigerant stored in the accumulator 220 from flowing backward into the receiver 210. That is, even though the second valve 245 may be a normal open valve, since the liquid refrigerant stored in the accumulator 220 is not introduced into the outlet end 242 of the bypass line 240, the refrigerant may not back flow into the receiver 210. Although a gas refrigerant exists at the outlet end 242 of the bypass line 240, since the gas refrigerant has a relatively low density, an amount of back flowing refrigerant may be ignored.

Since the inlet end 241 of the bypass line 240 is connected to a lower portion of the receiver 210, i.e., the receiver cover 212, all the liquid refrigerant stored in the receiver 210 may be transferred into the accumulator 220 through the bypass line 240 as necessary. Thus, circulation of refrigerant may be adjusted to maximize performance.

Figure 6:
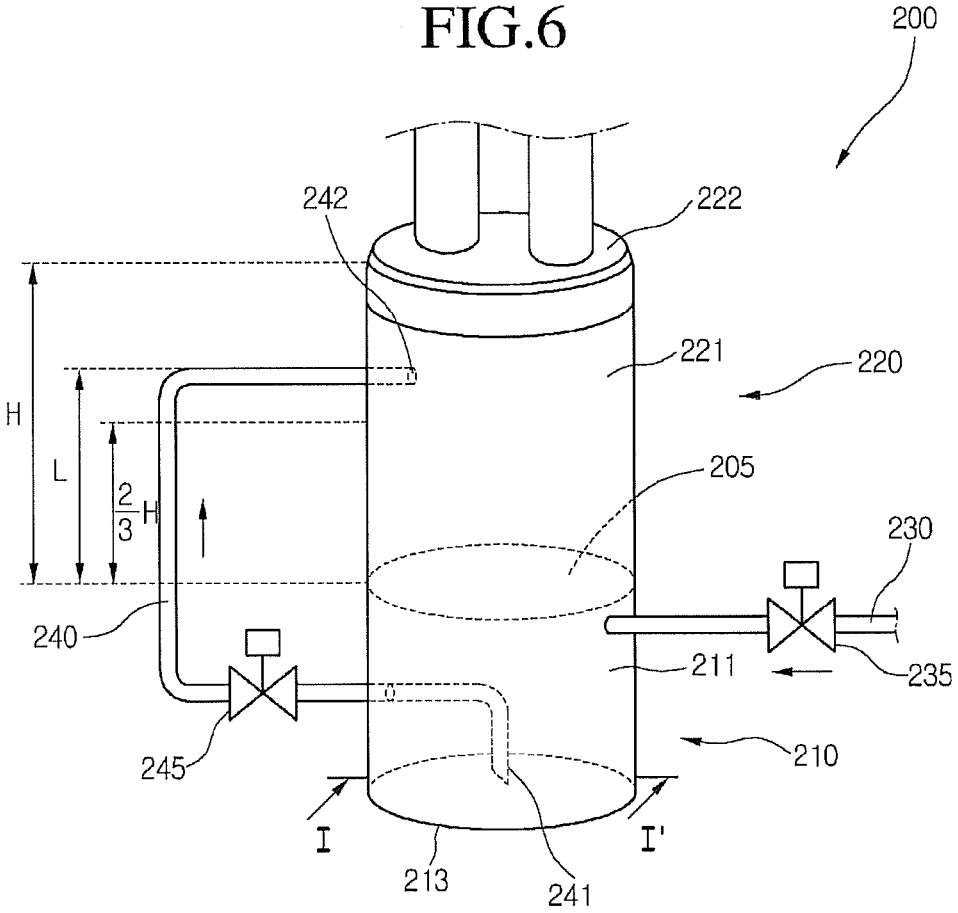
FIG. 6 is a perspective view of a refrigerant storage device of an air conditioner, according to an embodiment as broadly described herein.
Figure 7:
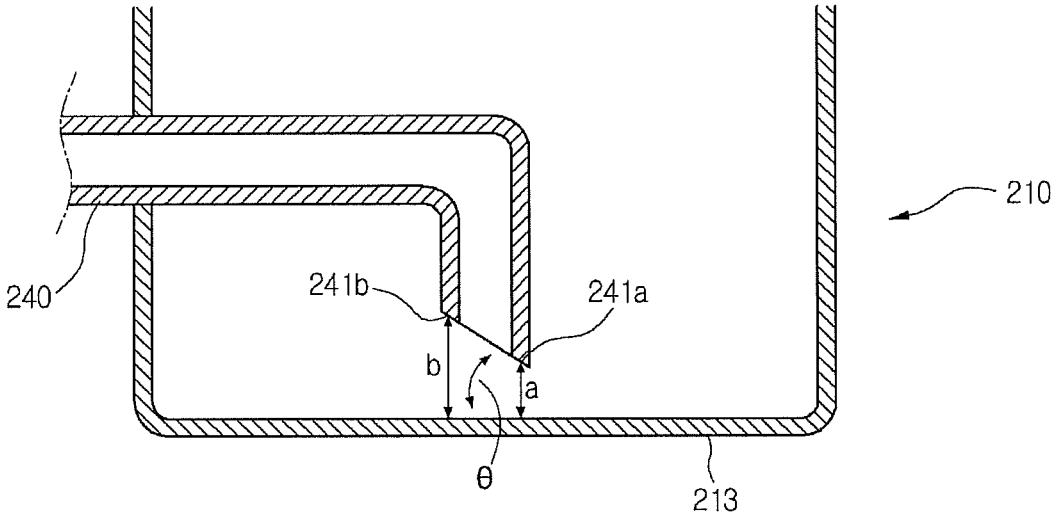
FIG. 7 is a cross-sectional view taken along line I-I' of FIG. 6.

FIG. 6 is a perspective view of a refrigerant storage device according to another embodiment, and FIG. 7 is a cross-sectional view taken along line I-I' of FIG. 6. Descriptions of components that duplicate the embodiment of FIG. 3 will be omitted.

Referring to FIG. 6, a bypass line 240 may be bent in a "⊏" shape overall, and then be connected to a receiver 210 and an accumulator 220. That is to say, the bypass line 240 may be disposed on side surfaces of a receiver body 211 and an accumulator body 221.

In detail, the outlet end 242 of the bypass line 240 may be disposed on an upper portion of a side surface of the accumulator body 221. In certain embodiments, the outlet end 242 of the bypass line 240 may be connected to the accumulator 220 at a position higher than a maximum storage height of the liquid refrigerant stored in the accumulator 220. In general, a maximum amount of liquid refrigerant stored in the accumulator 220 may be about ⅔ of a height H of the accumulator 220. Thus, a formation position L of the outlet end 242 of the bypass line 240 may be higher than ⅔H, or about ⅔ of the height H of the accumulator 220.

The bypass line 240 may penetrate a side surface of the receiver body 211. In this case, the inlet end 241 of the bypass line 240 may be disposed within the receiver 210. Since the liquid refrigerant having a relatively high density when compared to that of a gas refrigerant is stored in a lower portion of the receiver 210, the inlet end 241 of the bypass line 240 may be disposed adjacent to a bottom portion 213 of the receiver 210. For example, the bypass line 240 may penetrate the side surface of the receiver body 211 and then be bent downward. In this case, the inlet end 241 may be spaced a predetermined distance from the bottom 213 of the receiver 210 so that the inlet end 241 is not blocked by the receiver bottom part 213.

Referring to FIG. 7, the inlet end 241 of the bypass line 240 may have at least one side thereof spaced apart from the bottom 213 of the receiver 210. In detail, a distance 'a' between the bottom 213 of the receiver 210 and one side 241*a* of the inlet end of the bypass line 240 and a distance 'b' between the bottom 213 and the other side 241*b* of the inlet end may be different from each other. For example, a section of the inlet end 241 of the bypass line 240 may be inclined at a predetermined angle θ (in a diagonal line shape) with respect to the bottom 213 of the receiver 210. In this case, the angle θ may be, for example, about 45°.

According to the current embodiment, since the inlet end 241 of the bypass line 240 penetrates the side surface of the receiver 210, a length of the overall structure may be shorter, and impact on overall height of the refrigerant storage device may be minimized. Also, even in the event of irregularities during manufacture such a shape of the inlet end 241 of the bypass line 240 may prevent the inlet end 241 of the bypass line 240 from being blocked by the bottom 213 of the receiver 210.

Hereinafter, operation of the integrated receiver and accumulator for an air conditioner, according to an embodiment, will be described.

The receiver suction tube 230 guides at least a portion of the refrigerant circulating through the air conditioner 100 into the receiver 210. The bypass line 240 guides the liquid refrigerant stored in the receiver 210 into the accumulator 220. The refrigerant passing through the bypass line 240 or the accumulator inflow tube 251 and then stored in the accumulator 220 may pass through the accumulator discharge tube 252 and be transferred to the compressor 140 in a gas state. Here, an amount of refrigerant passing through the receiver suction tube 230 may be adjusted by the first valve 235, and an amount of refrigerant passing through the bypass line 240 may be adjusted by the second valve 245.

In a case an amount of the refrigerator required is greater than a circulating refrigerant amount, for example, in a case where the number of operating indoor units 110 increases, the first valve 235 may be closed, and the second valve 245 may be opened to prevent introduction of circulating refrigerant into the receiver 210 guide liquid refrigerant stored in the receiver 210 into the accumulator 220. A gas refrigerant of the refrigerant stored in the accumulator 220 may pass through the accumulator discharge tube 252 and then be transferred to the compressor 140. Thus, an amount of refrigerant circulating into the air conditioner 100 may increase and thus be adequately adjusted according to the number of operating indoor units 110.

In a case where a required refrigerant amount is less than a circulating refrigerant amount, for example, in a case where the number of operating indoor units 110 decreases, the first valve 235 may be opened, and the second valve 245 may be closed. Thus, the circulating refrigerant may be introduced into the receiver 210, and introduction of the liquid refrigerant stored in the receiver 210 into the accumulator 220 may be prevented, so that an amount of refrigerant circulating into the air conditioner 100 may decrease and be adequately adjusted according to the number of operating indoor units 110.

Figure 8:
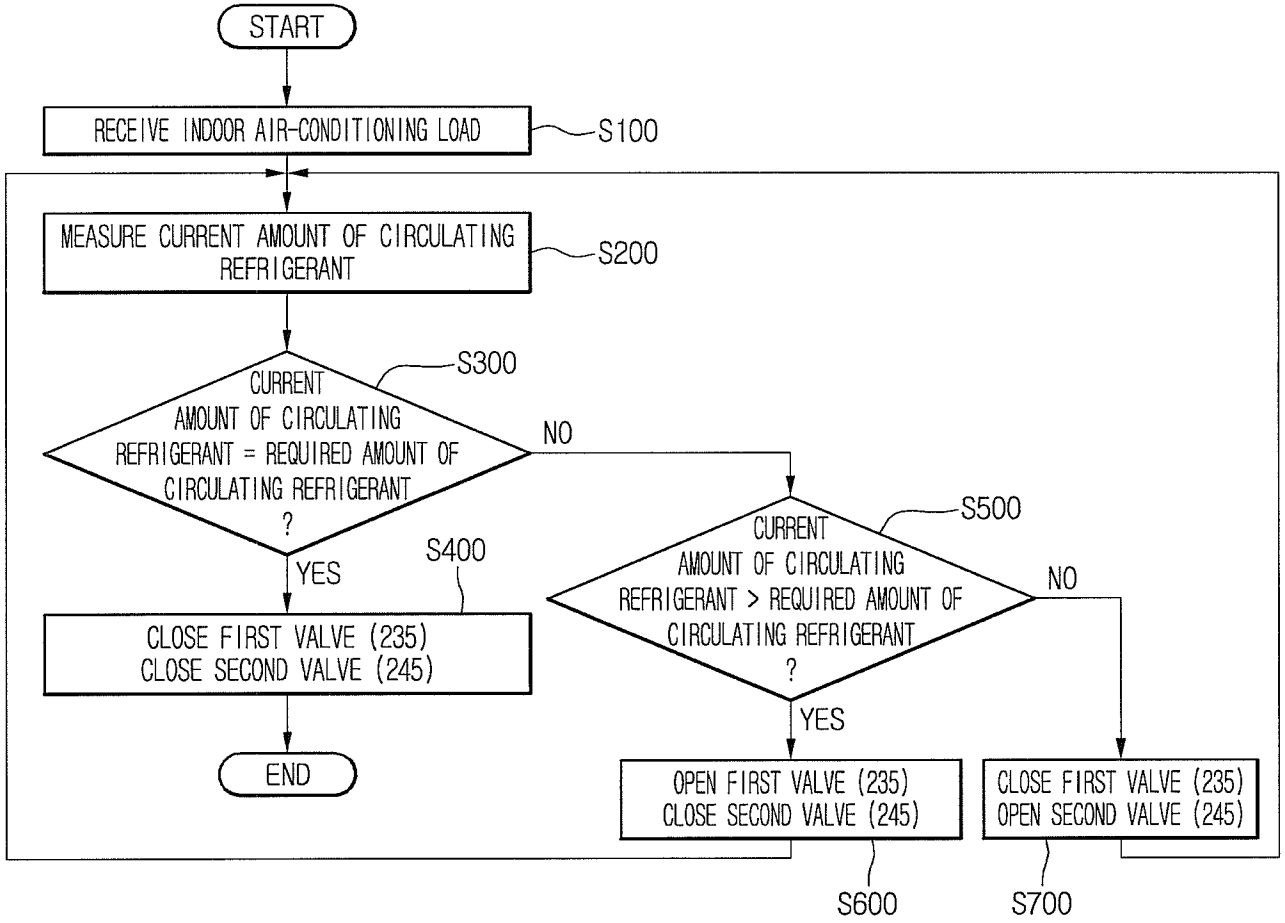
FIG. 8 is a flowchart of a process of controlling an air conditioner, according to an embodiment as broadly described herein.

FIG. 8 is a flowchart of a process of controlling an air conditioner, according to an embodiment as broadly described herein.

Referring to FIG. 8, first an indoor air-conditioning load is received (S100). The indoor air-conditioning load may be a load corresponding to the number of operating indoor units 110 of the plurality of indoor units 110 and cooling/heating capacity required in each indoor unit 110. The amount of refrigerant required to circulate within the air conditioner 100 may be determined using the indoor air-conditioning load.

Next, the current amount of refrigerant circulating is measured (S200). Various methods for measuring the current amount of circulating refrigerant may be applied. For example, a flow rate within the circulation tube may be directly measured or a flow rate may be measured and converted into a flow amount. Also, since the sum of an amount of refrigerant circulating into the air conditioner 100 and an amount of refrigerant stored in the receiver 210 is essentially constant, an amount of refrigerant stored in the receiver 210 may be indirectly measured to determine the amount of circulating refrigerant.

It is determined whether the current amount of circulating refrigerant and the required amount of circulating refrigerant are the same by comparing the current amount to the required amount (S300). If the current amount is equal to the required amount, the first and second valves 235 and 245 are blocked to maintain a constant amount of refrigerant stored in the receiver 210 (S400). Since a constant amount of refrigerant is stored in the receiver 210, the current amount of circulating refrigerant may be maintained.

If the current amount of circulating refrigerant is not equal to the required amount of circulating refrigerant, it is determined whether the current amount of circulating refrigerant is greater than the required amount of circulating refrigerant (S500). If the current amount is greater than the required amount, the first valve 235 is opened to introduce the refrigerant from the circulation tube, and then the second valve 245 is closed to prevent the refrigerant from being supplied from the receiver 210 into the accumulator 220. An amount of refrigerant flowing in the circulation tube may be reduced through the control of the first and second valves 235 and 245. Also, a process (S200) of measuring the current amount of circulating refrigerant, a process (S300) of comparing the current amount of circulating refrigerant to the required amount of circulating refrigerant, and a subsequent process of controlling the first and second valves 235 and 245 accordingly may be repeatedly performed.

If the current amount of circulating refrigerant is less than the required amount of circulating refrigerant, the first valve 235 is closed to prevent the refrigerant flowing in the circulation tube from being introduced into the receiver 210, and the second valve 245 is opened to supply the refrigerant stored in the receiver 210 into the accumulator 220 (S700). The first and second valves 235 and 245 may be controlled to increase an amount of refrigerant flowing in the circulation tube. Also, a process (S200) of measuring the current amount of circulating refrigerant, a process (S300) of comparing the current amount of circulating refrigerant to the required amount of circulating refrigerant, and a process of controlling the first and second valves 235 and 245 may be repeatedly performed According to the current embodiment, the receiver and the accumulator may be integrally manufactured to reduce manufacturing costs and realize efficient space utilization.

Also, the outlet end 242 of the bypass line 240 may be connected to the upper portion of the accumulator 220 to prevent the liquid refrigerant stored in the accumulator 220 from back flowing into the receiver 210.

Also, the inlet end 241 of the bypass line 240 may be connected to the lower portion of the receiver 210 to maximize circulating refrigerant adjustment performance using the receiver 210.

Also, since the inlet end 241 of the bypass line 240 penetrates the side surface of the receiver 210, a length of the overall structure may be shorter. In this case, since at least one side of the inlet end 241 of the bypass line 240 is spaced apart from the bottom 213 of the receiver 210, even though tolerance issues may occur in the manufacturing process, the inlet end 241 of the bypass line 240 will not be blocked by the bottom 213 of the receiver.

Also, the outlet end 231 of the receiver suction tube 230 may be connected to the upper portion of the receiver body 211 to prevent the liquid refrigerant stored in the receiver 210 from back flowing through the receiver suction tube 230.

Embodiments provide an air conditioner in which a receiver and an accumulator may be integrated with each other.

In one embodiment, an air conditioner as broadly described herein may include a compressor, a condenser, an evaporator, a receiver storing at least one portion of a refrigerant passing through the condenser, an accumulator in which the refrigerant stored in the receiver and a refrigerant passing through the evaporator are introduced, the accumulator separating a gas refrigerant from refrigerant introduced thereinto and supplying the gas refrigerant into the compressor, and a bypass line supplying the refrigerant stored in the receiver into the accumulator, wherein the receiver and the accumulator are integrated with each other or provided as separate parts to couple each other, and an outlet end of the bypass line is connected to an upper portion of the accumulator.

The outlet end of the bypass line may be connected to a side surface of the accumulator. The outlet end of the bypass line may be connected to the accumulator at a position greater than that corresponding to a maximum storage height of the liquid refrigerant stored in the accumulator.

The outlet end of the bypass line may be connected to a top surface of the accumulator.

The air conditioner may also include an upper end cover covering an upper portion of the accumulator, wherein an accumulator inflow tube guiding the refrigerant from the evaporator into the accumulator, an accumulator discharge tube guiding the refrigerant from the accumulator into the compressor, and the bypass line may be connected to the upper end cover.

An inlet end of the bypass line may be connected to a lower portion of the receiver. The inlet end of the bypass line may be connected to a bottom surface of the receiver. The bypass line may pass through a side surface of the receiver, and at least one portion of the inlet end of the bypass line may be spaced apart from an inner bottom surface of the receiver.

A section of the inlet end of the bypass line may be inclined with respect to a section of the inner bottom surface of the receiver.

A height from the inner bottom surface of the receiver to one side of the inlet end of the bypass line may be greater than that from the inner bottom surface of the receiver to the other side of the inlet end of the bypass line.

The air conditioner may also include a receiver suction tube guiding at least one portion of the refrigerant passing through the condenser toward the receiver, wherein the receiver suction tube may be connected to an upper portion of the receiver.

The air conditioner may also include a first valve disposed in the receiver suction tube to control an amount of refrigerant suctioned into the receiver, and a second valve disposed in the bypass line to control an amount of refrigerant supplied from the receiver to the accumulator.

At least a valve of the first valve and the second valve may be normal open valve.

The receiver may be disposed under the accumulator.

The receiver and the accumulator may be respectively defined as spaces divided by a partition wall disposed within the single housing.

In another embodiment, an air conditioner as broadly described herein may include a compressor, a condenser, an evaporator, a refrigerant circulation tube, a receiver storing at least one portion of a refrigerant flowing in the refrigerant circulation tube, an accumulator disposed at a upper side of the receiver to introduce the refrigerant stored in the receiver and a refrigerant passing through the evaporator and separate the introduced refrigerant into a gas refrigerant and a liquid refrigerant, thereby supplying the gas refrigerant into the compressor, and a bypass line supplying the refrigerant stored in the receiver into the accumulator.

An outlet end of the bypass line may be connected to an upper portion of the accumulator, and an inlet end of the bypass line may be connected to a lower portion of the receiver.

The receiver and the accumulator may be respectively defined as spaces vertically divided by a partition wall disposed within the single housing.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a compressor, a condenser and an evaporator connected to form a refrigerating cycle;

a receiver that stores a portion of refrigerant for the refrigerating cycle;

an accumulator configured to receive refrigerant from the receiver and refrigerant from the evaporator, and to separate a gas refrigerant from the refrigerant received therein and supply the gas refrigerant to the compressor;

a bypass line connected between the receiver and the accumulator to supply refrigerant stored in the receiver to the accumulator;

a receiver suction tube connected to an upper portion of the receiver that guides at least a portion of the refrigerant passing through the condenser to the receiver;

a first valve provided in the receiver suction tube to control an amount of refrigerant suctioned into the receiver; and a second valve provided in the bypass line to control an amount of refrigerant supplied from the receiver to the accumulator, wherein the receiver and the accumulator are integrally formed or are provided as separate parts coupled to each other, and wherein an outlet end of the bypass line is connected to an upper portion of the accumulator.

2. The air conditioner according to claim 1, wherein the outlet end of the bypass line extends through an accumulator cover positioned on a top of the accumulator to discharge refrigerant into an interior of the accumulator.

3. The air conditioner according to claim 2, wherein an inlet end of the bypass line extends through a receiver cover positioned on a bottom of the receiver to draw refrigerant from an interior of the receiver.

4. The air conditioner according to claim 1, wherein the outlet end of the bypass line extends through a lateral side surface of the accumulator.

5. The air conditioner according to claim 1, wherein the outlet end of the bypass line is connected to the accumulator at a position vertically above a maximum storage height of liquid refrigerant received in the accumulator.

6. The air conditioner according to claim 2, wherein an accumulator inflow tube that guides refrigerant from the evaporator into the accumulator, an accumulator discharge tube that guides refrigerant from the accumulator to the compressor, and the bypass line are each connected to the accumulator cover.

7. The air conditioner according to claim 1, wherein the bypass line passes through a lateral side surface of the receiver, and the inlet end of the bypass line is spaced apart from an inner bottom surface of the receiver.

8. The air conditioner according to claim 7, wherein the inlet end of the bypass line is inclined with respect to the inner bottom surface of the receiver.

9. The air conditioner according to claim 7, wherein a distance from the inner bottom surface of the receiver to a first side of the inlet end of the bypass line is greater than a distance from the inner bottom surface of the receiver to a second side of the inlet end of the bypass line.

10. The air conditioner according to claim 1, wherein one of the first valve or the second valve is a normally open valve.

11. The air conditioner according to claim 1, wherein a receiver body that defines an outer appearance of the receiver is positioned under an accumulator body that defines an outer appearance of the accumulator.

12. The air conditioner according to claim 1, wherein the receiver and the accumulator are respectively defined within an interior space formed in a single housing divided by a partition wall disposed within the single housing.

13. An air conditioner, comprising:

a compressor, a condenser, an evaporator and a refrigerant circulation tube that forms-a refrigerating cycle;

a receiver that stores a portion of refrigerant flowing in the refrigerant circulation tube;

an accumulator provided above the receiver and configured to receive refrigerant from the receiver and refrigerant from the evaporator, to separate the received refrigerant into a gas refrigerant and a liquid refrigerant, and to supply the gas refrigerant to the compressor, and a bypass line that extends between a bottom of the receiver and a top of the accumulator to supply refrigerant from the receiver to the accumulator, wherein the receiver and the accumulator are respectively defined within an interior space formed in a single housing divided by a partition wall disposed within the single housing.

14. The air conditioner according to claim 13, wherein an outlet end of the bypass line is connected to an upper portion of the accumulator.

15. The air conditioner according to claim 14, wherein an inlet end of the bypass line is connected to a lower portion of the receiver.

16. The air conditioner according to claim 13, wherein the partition wall is horizontally disposed within the single housing.

17. A method of operating an air conditioning system including an outdoor device connected to one or more indoor devices, the method comprising:

receiving an indoor air conditioning load;

determining a current amount of refrigerant circulating through the air conditioning system;

comparing the determined current amount to a previously stored required amount of refrigerant corresponding to the received indoor air conditioning load;

closing a first valve provided on a bypass line between a receiver and an accumulator, and closing a second valve provided on a suction tube introducing refrigerant into the receiver, when the current amount is equal to the required amount;

opening the first valve and closing the second valve when the current amount is greater than the required amount; and closing the first valve and opening the second valve when the current amount is less than the required amount.

* * * * *